United States Patent [19]

Gazzoni

[11] 4,185,925

[45] Jan. 29, 1980

[54] TAPERED-END SILO, ESPECIALLY FOR SMALL-SIZED PLASTICS MATERIAL

[75] Inventor: Domenico Gazzoni, Como, Italy

[73] Assignee: Sorema S.r.l., Erba, Italy

[21] Appl. No.: 916,737

[22] Filed: Jun. 19, 1978

[51] Int. Cl.[2] ..... B01F 7/16

[52] U.S. Cl. ..... 366/69; 366/186; 366/323

[58] Field of Search ..... 366/186, 320, 323, 319, 366/69, 603, 65

[56] References Cited

U.S. PATENT DOCUMENTS

| | | | |
|---|---|---|---|
| 3,019,895 | 2/1962 | Loevenstein et al. | 366/323 X |
| 3,183,553 | 5/1965 | Slater | 366/323 |
| 4,117,073 | 9/1978 | Koch et al. | 366/69 |

FOREIGN PATENT DOCUMENTS

| | | | |
|---|---|---|---|
| 1208570 | 9/1959 | France | 366/319 |

*Primary Examiner*—George F. Mautz

*Attorney, Agent, or Firm*—Stevens, Davis, Miller & Mosher

[57] ABSTRACT

This invention relates to a silo having a tapered bottom end, which silo is particularly adapted for small-sized plastics materials having a high degree of stickiness, humidity and electrostaticity. The silo according to the invention comprises a conical-screw stirring member axially inserted in the conical bottom of the silo, said stirring member being so constructed and rotated about its own axis as to originate an upward motion of the material. An outlet part is arranged laterally at the lower end of the silo bottom in order to eject and deliver the material.

2 Claims, 3 Drawing Figures

TAPERED-END SILO, ESPECIALLY FOR SMALL-SIZED PLASTICS MATERIAL

This invention relates to a silo having a tapered bottom end, which is particularly adapted, even if not exclusively, for small-sized plastics materials having a high degree of stickiness, humidity and electrostaticity.

It is known that the storage in silo of plastics materials having the characteristics enumerated above involves considerable problems as regards the metered dispensing of the material once the storage period comes to an end.

By virtue of their characteristics, the individual small pieces of material tend to stick to each other, thus forming in the low section of the silo a single agglomeration of solids which acts like a "bridge" or a "plug" for the overlying stock.

This fact is conducive, as it is universally recognized in the art, the necessity of keeping the material continually stirred, especially in the lower section of the silos having a tapered bottom, wherein the occurrence of bridging is more likely.

The approaches as suggested heretofore in the conventional silos are not fully satisfactory under this particular respect, since they are unable to maintain the entire mass of material in the desirable status of stirring, but only portions of the material are influenced and, in addition, motors of high power are required in order that the stirrers may properly be actuated.

The principal object of the present invention is to provide a tapered-bottom silo which is particularly, even if not quite exclusively, adapted to plastics materials of the characteristics enumerated above and in which the problem of stirring the material is brilliantly and thoroughly solved.

Another object of the present invention is, then, to provide a silo of the kind referred to above, which is also capable of ensuring a particularly accurate and constant metering of the material to be dispensed from time to time.

According to the invention, these objects are achieved by means of a tapered-end silo, characterized in that it comprises a conical-helix stirring member which is axially inserted into the tapered end of the silo, said stirring member being so constructed and so rotatably driven about its axle as to produce an upward motion of the material which is manipulated by the stirrer's conical vane, means being provided for ejecting and delivering the material, said means including an outlet port arranged laterally relative to said stirring member in correspondence with the bottom end of the tapered end of the silo.

The use, as suggested herein, of a helical-conical stirrer permits to solve once for all the problem of stirring the material which is held in the tapered end of the silo. Such a stirrer, in fact, originates within the material concerned a continuous lifting motion, and an appropriate sizing of the conical helix relative to the silo bottom can extend such a motion laterally in such a way as to involve all the material contained in the tapered end of the silo, with the only exception of a narrow peripheral annulus along which the material, conversely, is enabled to fall by the gravity pull only and thus to attain the outlet port and to pass therethrough in order that a constant output may be warranted and thereby a metering of the delivery which is also constant. No undesirable clogging or bridging phenomena are experienced so that the silo is constantly maintained under quite satisfactory working conditions. Inasmuch as, on the other hand, a comparatively slow motion of the material is sufficient, the use of a driving motor having a limited power is also appropriate, the result being that the silo becomes less expensive and the power demand is considerably reduced.

The characteristics of the present invention will become more clearly apparent from the ensuing detailed description of a practical embodiment thereof which is shown by way of example only in the accompanying drawings.

Figure 1:
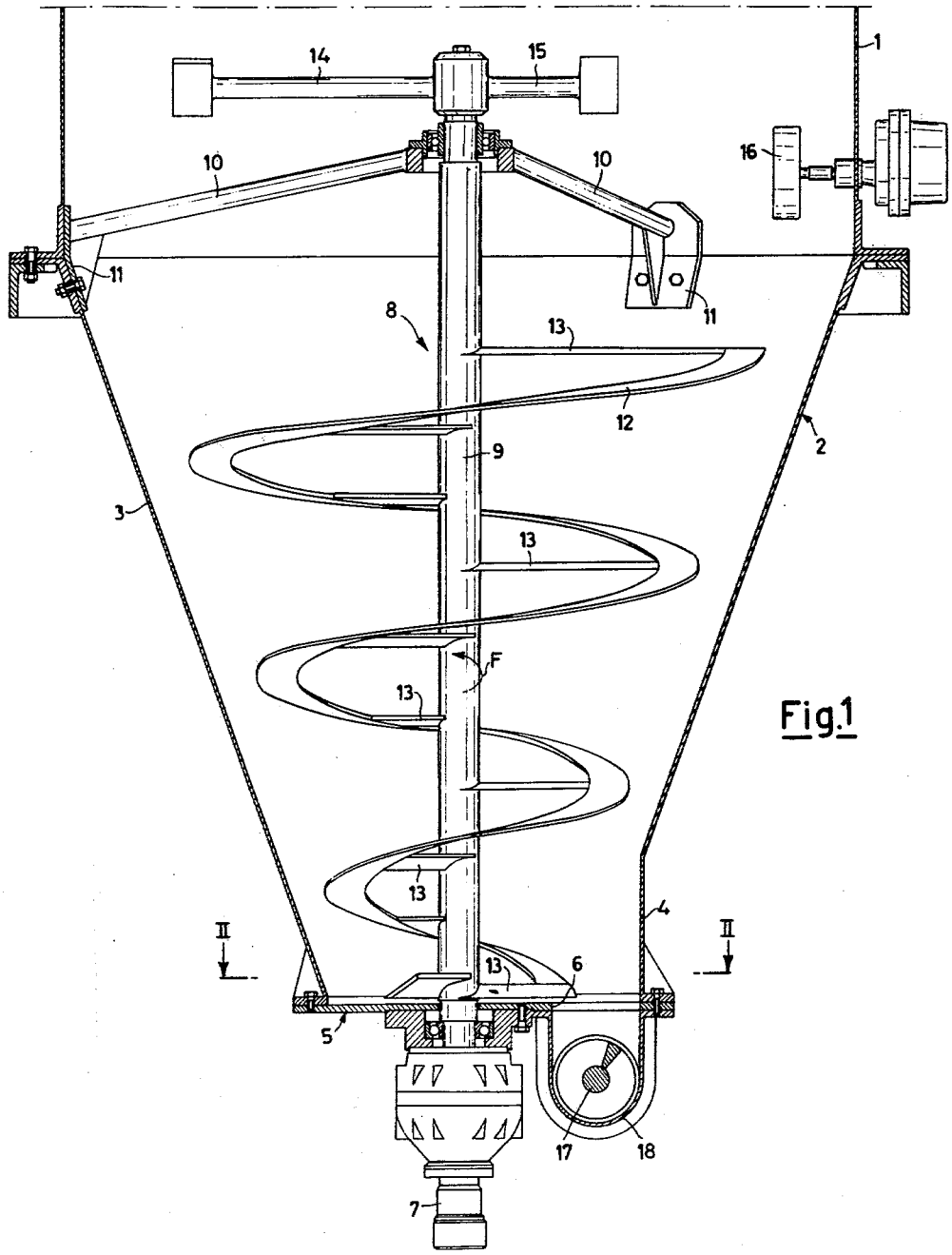
FIG. 1 is an axial cross-sectional view of the lower portion of a silo according to this invention.
Figure 2:
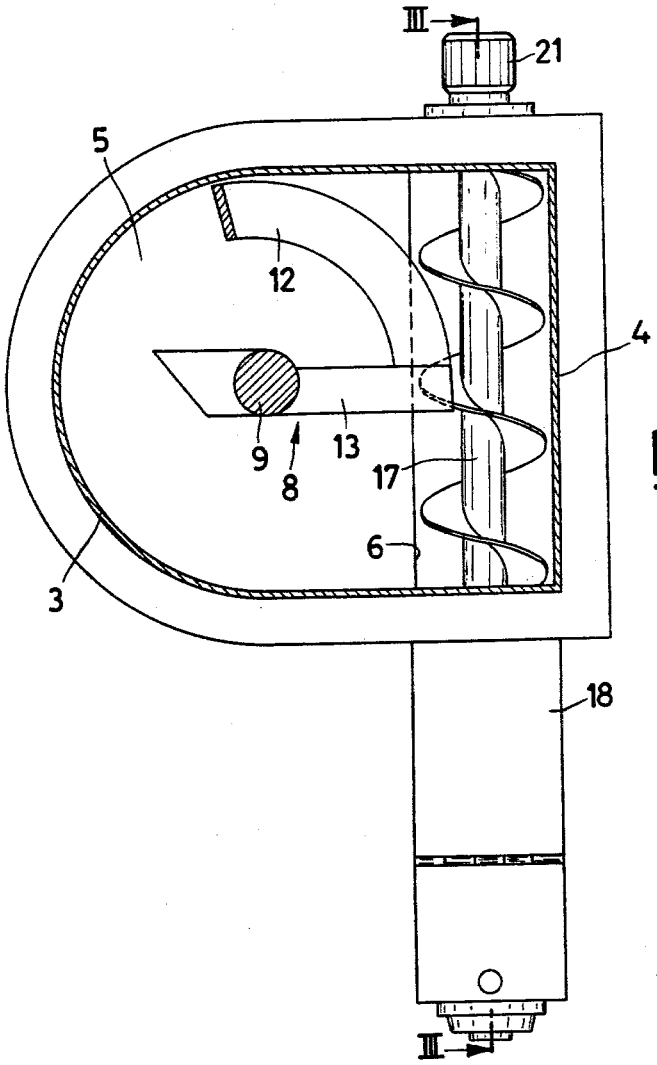
FIG. 2 shows the same lower portion of the silo in transversal cross-sectional view taken along the line II—II of FIG. 1.

The silo as depicted in the drawings essentially comprises a cylindrical wall, 1, which is axially developed almost along the entire vertical extension of the silo, with the only exception of a bottom section, 2, having a tapered wall 3 which is terminated at its end by a squared section 4 (FIGS. 1 and 2).

A plate 5, having a rectangular window 6 which is laterally offset towards the squared wall 4 closes at the bottom the tapered end 2 of the silo and supports in a central position, that is to say along the axis of the conical wall 3 and of the overlying cylindrical wall 1, a motor 7 intended to drive to rotation a conical screw stirrer 8 as inserted into the conical bottom 2.

The stirrer in question comprises a central shaft 9 borne by the motor 7 and maintained in a true axial position by three arms 10 (only two are shown in FIG. 1) angularly spaced apart through 120 degrees from each other and fastened by plates 11 to the junction area between the walls 1 and 3. Around the shaft 9 there is a conical screw 12 which is fastened to such a shaft by means of radial spokes 13.

To the top of the shaft 9 are also fastened two paddles 14 and 15 having different radii, which provide to keep the material above the arms 10 under stirring. In such an area a level gauge 16 is additionally provided.

Figure 3:
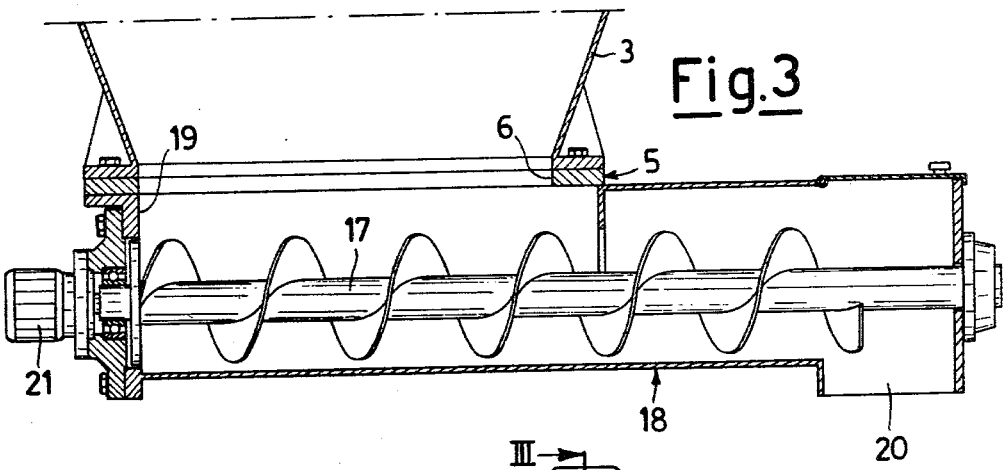
FIG. 3 shows the outlet section of the silo in cross-sectional view, taken along the line III—III of FIG. 2.

Beneath the plate 5 and in registry with the rectangular window 6, there is arranged, lastly, in a transversal direction, a cylindrical dispensing screw 17, which is borne for rotation by a cylindrical box 18: the latter has an inlet mouth 19 and an outlet port 20 and is driven to rotation by a motor 21 (FIGS. 2 and 3).

In operation, the motor 7 rotates, in the direction shown by the arrow F in FIG. 1 the conical-helical stirrer 8, which induces a slow upward motion of the material that stays in the inside of the conical enveloping surface of the screw 12.

The material then falls by gravity along the conical sidewall 3 and originates an outlet stream with a constant rate of output through the outlet port 6. The constancy of the rate of flow is ensured by the noncompressed conditions under which the material is the conical section 2 due to the effects of the stir originated by the screw 8 and the bearing action of the overlying material in the cylindrical section 1, as provided by the spokes 10.

It should be noticed that the movement originated by the screw 8 also provides, if required, the admixture of possible different materials introduced in the silo together. The transversal screw 17, lastly, provides to deliver constant metered bursts of material in correspondence with the dispensing port 20.

I claim:

1. A tapered-bottom silo, particularly suitable for small sized plastics material having characteristics of low density and a high degree of stickiness, humidity and electrostaticity, characterized in that it comprises a conicalscrew stirring member with constantly increasing diameter and constant pitch and vane inclination from the bottom axially inserted into the conical silo bottom, said stirring member being so constructed and rotated about its own axis as to originate an upward motion of the material involved by its conical enveloping surface, means being provided for ejecting and delivering the material, said means including an outlet port arranged laterally relative to said stirring member in a lateral enlargement of the silo in correspondence with the lower end of the conical silo bottom end.

2. A silo according to claim 1, characterized in that it comprises a cylindrical dispensing screw arranged transversally beneath said outlet port.

* * * * *